US008444259B2

(12) United States Patent
Bennett

(10) Patent No.: US 8,444,259 B2
(45) Date of Patent: May 21, 2013

(54) RECIRCULATING INK SYSTEM FOR INKJET PRINTING

(75) Inventor: Simon Bennett, Letchworth (GB)

(73) Assignee: Xennia Technology Limited, Hertfordshire (GB)

( * ) Notice: Subject to any disclaimer, the term of this patent is extended or adjusted under 35 U.S.C. 154(b) by 390 days.

(21) Appl. No.: 12/808,303

(22) PCT Filed: Dec. 17, 2008

(86) PCT No.: PCT/GB2008/051195

§ 371 (c)(1), (2), (4) Date: Jul. 23, 2010

(87) PCT Pub. No.: WO2009/077790

PCT Pub. Date: Jun. 25, 2009

(65) Prior Publication Data

US 2010/0289857 A1 Nov. 18, 2010

(30) Foreign Application Priority Data

Dec. 18, 2007 (GB) ..... 0724606.9

(51) Int. Cl.
*B41J 2/18* (2006.01)
*B41J 2/175* (2006.01)

(52) U.S. Cl.
USPC ..... 347/89; 347/75

(58) Field of Classification Search
USPC ..... 347/7, 85, 86, 89
See application file for complete search history.

(56) References Cited

U.S. PATENT DOCUMENTS 4,896,172 A * 1/1990 Nozawa et al. ..... 347/89
5,936,650 A * 8/1999 Ouchida et al. ..... 347/89

(Continued)

FOREIGN PATENT DOCUMENTS

JP H08-150725 A 6/1996
JP H10-175315 A 6/1998

(Continued)

OTHER PUBLICATIONS

International Search Report issued in PCT Application No. PCT/GB2008/051195.

*Primary Examiner* — Anh T. N. Vo
(74) *Attorney, Agent, or Firm* — Morgan, Lewis & Bockius LLP

(57) ABSTRACT

An ink reservoir (10) for an ink recirculating system for supplying ink to an inkjet printhead (14) comprises a first chamber (16) for receiving ink from a main ink supply (12) and having a printhead outlet (24) for supplying ink to a printhead (14); and a second chamber (18) in fluid communication with the first chamber for receiving ink from the first chamber in excess of a predetermined height in the first chamber determined by the position of a transfer outlet (20), the second chamber having a printhead inlet (30) for receiving ink recirculated from the printhead and having a return outlet (40) for returning to the main ink (12) supply ink in excess of a predetermined height in the second chamber determined by the position of the return outlet (40), the transfer outlet (20), in use, being vertically above the return outlet (40). In use of the reservoir, because the transfer outlet (20) of the first chamber is vertically above the return outlet (40) of the second chamber, this produces a pressure differential that causes flow of ink from the first chamber (16) to the printhead (14) via the printhead outlet (24), through the printhead (14), with unused ink returned to the second chamber (18) via the printhead inlet (30). The unused ink is then returned to the main supply (12) for reuse, thus circulating surplus ink through the system. The arrangement thus uses gravity to produce the ink flow through the printhead (14), without the need for pumps, level sensors, valves etc. The ink reservoir is self-regulating, with the ink heights in the first and second chambers, and hence the pressure differential, determined by the relative heights of the two outlets.

13 Claims, 3 Drawing Sheets

U.S. PATENT DOCUMENTS

| | | | | |
|---|---|---|---|---|
| 6,357,867 | B1 | 3/2002 | Hine | 347/89 |
| 6,984,029 | B2 * | 1/2006 | Bellinger et al. | 347/86 |
| 7,182,444 | B2 * | 2/2007 | Kawamoto | 347/85 |
| 7,628,475 | B2 * | 12/2009 | Langford et al. | 347/84 |
| 7,901,063 | B2 * | 3/2011 | Wouters et al. | 347/89 |

FOREIGN PATENT DOCUMENTS

| | | |
|---|---|---|
| WO | WO 02/096654 | 12/2002 |
| WO | WO 2006/030235 | 3/2006 |
| WO | WO 2006/064036 | 6/2006 |

* cited by examiner

RECIRCULATING INK SYSTEM FOR INKJET PRINTING

The present application is a U.S. National Phase Application of International Application PCT/GB2008/051195, filed Dec. 17, 2008, which claims the benefit of priority of Great Britain Application No. 0724606.9, filed Dec. 18, 2007, the disclosures of which are incorporated herein by reference in their entireties.

FIELD OF THE INVENTION

This invention relates to inkjet printing and concerns apparatus and methods relating to recirculating ink systems for inkjet printing.

BACKGROUND TO THE INVENTION

Recirculating ink systems for inkjet printing, in which ink is recirculated through inkjet printheads, have benefits for the condition of the ink, particularly inks containing suspended solids, such as pigmented inks, reducing the likelihood of suspended solids settling out and also reducing air bubble formation, leading to improved printing performance and reliability.

Recirculating ink systems are not currently widespread, and some existing inkjet systems only allow for ink recirculation during non-printing periods, as the method employed for recirculation means that it is not possible to maintain the required constant negative pressure at the printhead nozzles whilst recirculation occurs.

Designs for ink systems to date that will allow recirculation to occur whilst maintaining a constant negative pressure, and thus allowing recirculation whilst printing, typically contain multiple printhead reservoirs, multiple pumps and multiple tubes to and from the main ink supply. See, e.g. U.S. Pat. No. 7,040,745. Multiple printhead reservoirs add cost and complexity to the ink system, as well as additional weight to the printhead carriage in a printing system. Multiple pumps add additional cost to the system, require control means and also are additional components that require service and replacement. Furthermore, it is desirable to minimise the number of tubes running from the main bulk ink supply to the printhead reservoir, as the reservoir is often mounted on a movable printhead carriage and thus the tubes must run through a flexible energy chain to the carriage. As the number of tubes used increases, the energy chain becomes larger, less flexible and more difficult to control. Known recirculating ink systems also generally have a relatively large ink capacity, e.g. at least about 1 liter.

WO 02/096654 (3M) discloses a recirculation system for pigmented inks using two reservoirs and a siphon effect to cause flow of ink through a printhead.

WO2006/030235 (Xaar) discloses in FIG. 8 an ink recirculation system using two chambers with weirs, with the chambers being maintained at different pressures to produce a pressure differential to drive ink through a printhead. Ink can flow from an inlet tank to an outlet tank, with the flow regulated by a valve in response to level sensors.

WO 2006/064036 (Agfa) concerns an ink circulation system for inkjet printing, with FIG. 3 showing apparatus including a printhead subtank with a weir separating first and second compartments of the subtank to produce a pressure differential for circulating ink through a printhead. The level of ink in the second compartment is controlled by level sensors acting to regulate a valve in flow lines leading to the main ink supply.

SUMMARY OF THE INVENTION

In one aspect, the present invention provides an ink reservoir for an ink recirculating system for supplying ink to an inkjet printhead, the ink reservoir comprising a first chamber for receiving ink from a main ink supply and having a printhead outlet for supplying ink to a printhead; and a second chamber in fluid communication with the first chamber for receiving ink from the first chamber in excess of a predetermined height in the first chamber determined by the position of a transfer outlet, the second chamber having a printhead inlet for receiving ink recirculated from the printhead and having a return outlet for returning to the main ink supply ink in excess of a predetermined height in the second chamber determined by the position of the return outlet, the transfer outlet, in use, being vertically above the return outlet.

In use of the reservoir, because the transfer outlet of the first chamber is vertically above the return outlet of the second chamber (when the reservoir is in an appropriate orientation for use), this produces a pressure differential that causes flow of ink from the first chamber to the printhead via the printhead outlet, through the printhead, with unused ink returned to the second chamber via the printhead inlet. The unused ink is then returned to the main supply for reuse, thus circulating surplus ink through the system. The arrangement thus uses a pressure difference to produce the ink flow through the printhead, without the need for pumps, level sensors, valves etc. The ink reservoir is self-regulating, with the ink heights in the first and second chambers, and hence the pressure differential, determined by the relative heights of the two outlets.

The reservoir of the present invention is thus simpler than that disclosed in WO 2006/064036, and does not need level sensors and valves to regulate the level of ink in the second chamber.

The ink is circulated through the main ink supply to the ink reservoir via appropriate fluid flow lines, e.g. tubes, typically by use of a circulating pump. A single pump is sufficient, and this may be located upstream (on the supply side) or downstream (on the return side) of the ink reservoir. Ink is circulated at an appropriate rate to keep the first and second chambers suitably filled to maintain the desired pressure differential, i.e. sufficiently quickly to keep the first chamber filled but not overfilled and without causing overfilling of the second chamber. A suitable flow rate can be readily determined for any given system.

The reservoir of the invention can be used for continuous recirculation of ink, both when the printhead is being used for printing and while the printhead is in an idle state.

The first and second chambers are preferably separated by a weir. Thus, in a preferred embodiment, the first and second chambers are located side by side, possibly being integrally formed in a single component, linked by an opening or passage constituting the transfer outlet of the first chamber and functioning as a weir, with ink in the first chamber flowing over the weir into the second chamber. This constitutes a simple but effective arrangement.

Alternatively, instead of a weir between the first and second chambers, the transfer outlet of the first chamber may be linked by a fluid flow line, e.g. a tube, to an inlet to the second chamber that is preferably located below the normal level of ink in the second chamber, i.e. vertically below the return outlet of the second chamber, so that ink flows into the second chamber from the first chamber from below the level of the ink and so does not unduly aerate the ink or create foam.

The first chamber suitably includes an inlet through which ink is supplied from the main ink supply. This inlet is preferably located below the normal level of ink in the first chamber, i.e. is vertically below the transfer outlet, so that ink flows into the first chamber from below the level of the ink and so does not unduly aerate the ink or create foam. The inlet of the first chamber is preferably at the same vertical height as the return outlet of the second chamber, producing a symmetrical arrangement. When such a symmetrical arrangement is used in embodiments with the first and second chambers separated by a weir, the reservoir can be used with the ink flowing in either direction and a constant pressure differential and flow characteristics can be easily maintained. With such an arrangement, the ink flow may be reversed and the reservoir system used in a reverse mode, possibly for a short time interval, which can be useful in maintaining the printhead and clearing any blockages that may have occurred.

The first chamber may optionally be provided with level sensor means. The level sensor means is used to control the rate of flow of ink into the first chamber: when sensing the ink level is low, the flow rate is increased (by increasing the speed of the circulating pump) to fill the first chamber to the level of the transfer outlet, and when sensing the first chamber is full and ink is flowing through the transfer outlet, the flow rate is reduced to maintain a slow, constant flow of ink through the outlet, e.g. over the weir.

The second chamber may similarly optionally be provided with level sensor means.

The size of a chamber may need to be increased to accommodate level sensor means.

The ink reservoir of the invention can be used in conjunction with standard conventional printheads and a standard conventional main ink supply, such as are readily available commercially, without modification being required. The reservoir finds particular application in drop-on-demand printers, including thermal printers and piezoelectric printers.

The ink reservoir of the invention can be constructed to be small and light compared to some complex prior art arrangements, as referred to above, and can be sized easily to sit on a conventional printhead, to move with the printhead during printing if appropriate. A prototype reservoir having a level sensor in the first chamber has been constructed that has an ink capacity of about 30 ml, and the capacity could be further reduced by omitting the level sensor and reducing the size of the first chamber. The reservoir is thus very versatile, and is useful particularly, but not exclusively, in industrial contexts, including high throughput product and packaging decoration, manufacturing applications, PCB, flat panel display, printed electronics, light emitting polymers and biotech applications.

The ink reservoir may be fabricated of any suitable material, as is known in the art, e.g. metals, or preferably plastics materials such as clear acrylic e.g. Perspex (Perspex is a Trade Mark) or acetal resin e.g. Delrin (Delrin is a Trade Mark). Delrin is easy to machine and is durable.

The air space above the ink in the chambers is sealed and is connected to means to regulate the pressure in the air space in the chambers. In use, the air space is suitably maintained at a slight negative pressure, typically in the range of −25 mm $H_2O$ to-a few hundred mm $H_2O$, e.g. in known manner, to produce the required constant negative pressure at the printhead nozzles to prevent "drool" and allow for reliable operation of the printhead.

The present invention also provides an ink recirculating system for supplying ink to an inkjet printhead, comprising an ink reservoir in accordance with the invention, a main ink supply, a first fluid supply line (e.g. a tube) connecting the main ink supply to the first chamber of the reservoir, a second fluid supply line (e.g. a tube) connecting the return outlet of the second chamber to the ink reservoir, and circulating pump means, e.g. a pump in one of the fluid supply lines.

The ink recirculating system optionally to advantage includes temperature regulation means for controlling the temperature of the ink to maintain constant the ink temperature and hence viscosity in known manner, such as the provision of channels for flow of temperature-controlled fluid (e.g. a water jacket) or locations for installation of electrical cartridge heaters. Where heating or cooling is involved, the reservoir should be constructed of suitably thermally conductive material.

The term "ink" is used herein to refer to any fluid suitable for inkjet printing and covers not only coloured inks used for printing monochrome and coloured images but also inks used in printing functional materials and for non-imaging applications. The invention has particular benefits with inks carrying particulate materials, especially inks with dense particles such as titanium dioxide that have a tendency to settle out.

The present invention also provides an inkjet printer including an ink recirculating system with an ink reservoir in accordance with the invention.

The invention also provides a method of providing a flow of ink from an ink reservoir to an inkjet printhead in an ink recirculating system in which ink is supplied from a main supply to a first chamber of the ink reservoir, ink from the first chamber in excess of a predetermined height in the first chamber is supplied to a second chamber of the ink reservoir, and ink from the second chamber in excess of a predetermined height in the second chamber is returned to the main ink supply for recirculation, so comprising circulating ink from the first chamber to the second chamber through the printhead as a result of the pressure differential caused by the height of the ink in the first chamber being vertically higher than the height of the ink in the second chamber, wherein the height of the ink in the first chamber is determined by the vertical location of a transfer outlet in the first chamber for passage of ink from the first chamber to the second chamber, and the height of the ink in the second chamber is determined by the vertical location of a return outlet in the second chamber for return to the main supply.

The invention will be further described, by way of illustration, with reference to the accompanying drawings, in which.

DETAILED DESCRIPTION OF THE DRAWINGS

Figure 1:
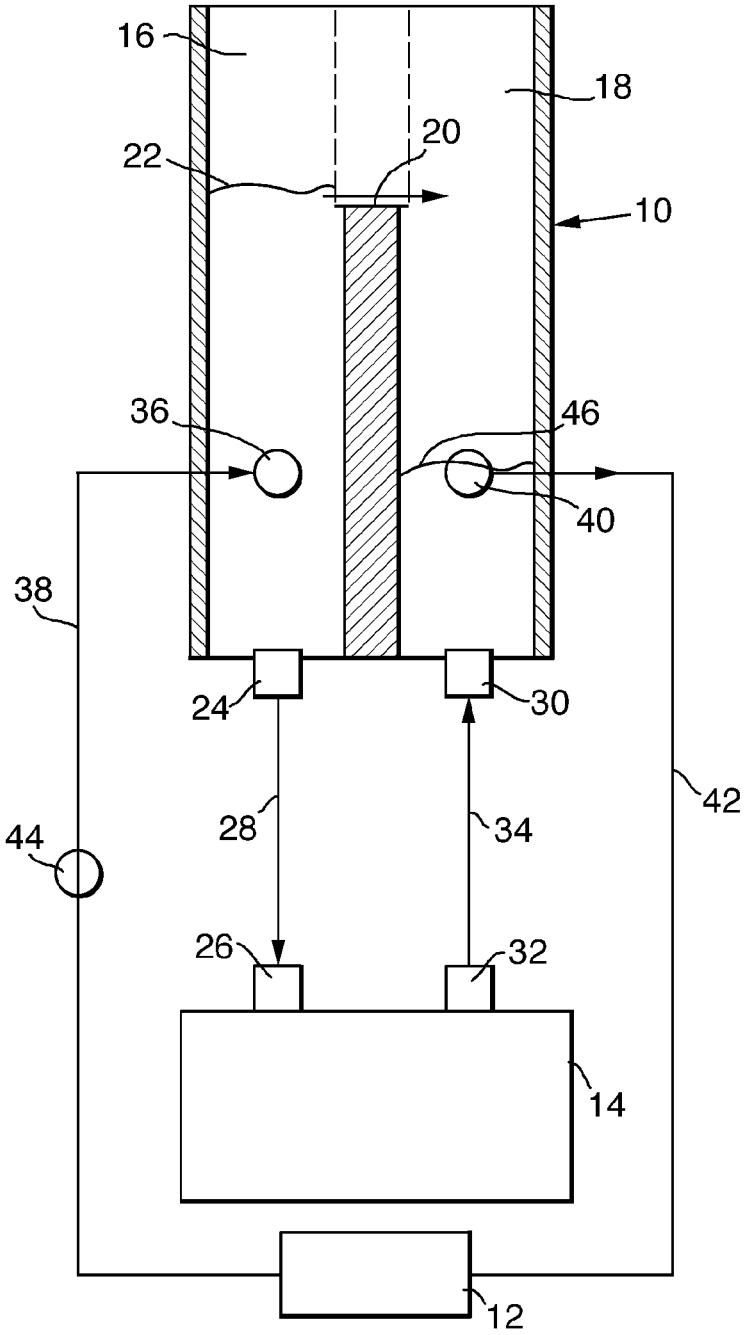
FIG. 1 is a schematic drawing illustrating an ink recirculating system in accordance to with the invention.
Figure 2:
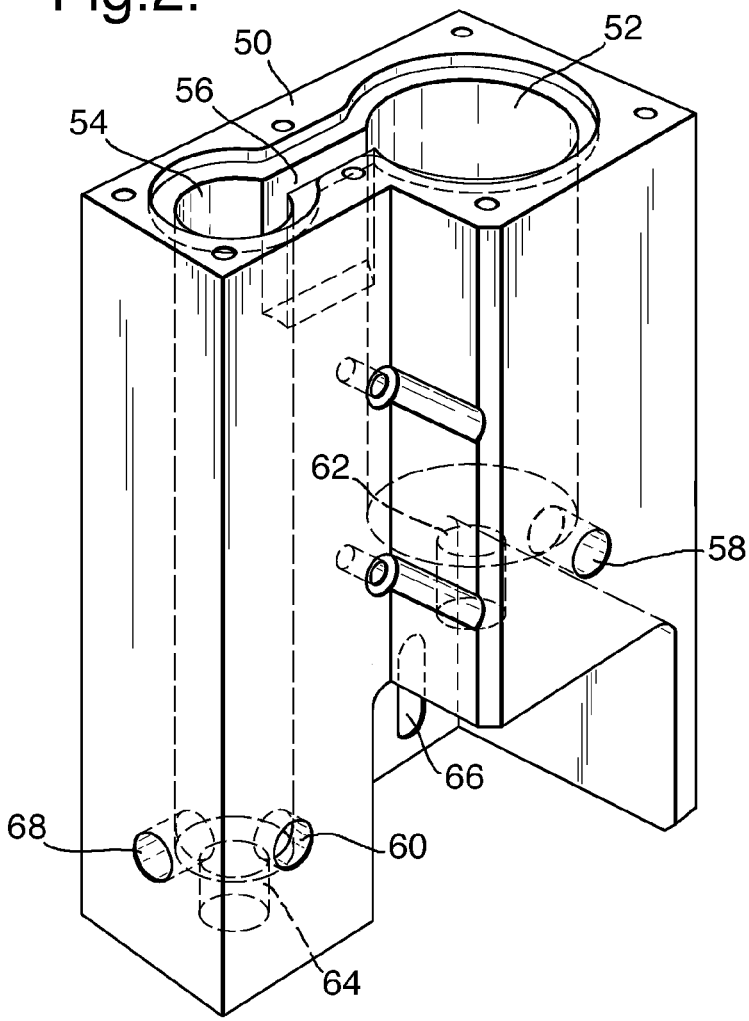
FIG. 2 is perspective view of a prototype embodiment of reservoir in accordance with the invention.
Figure 6:
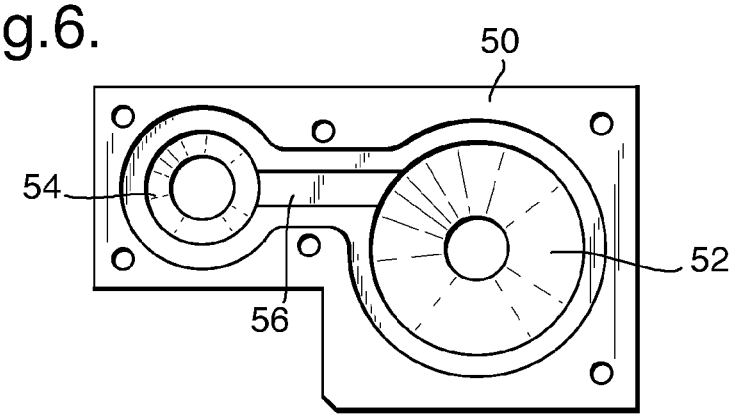
FIG. 6 is a top plan view of the reservoir of FIGS. 1 to 5.
Figure 3:
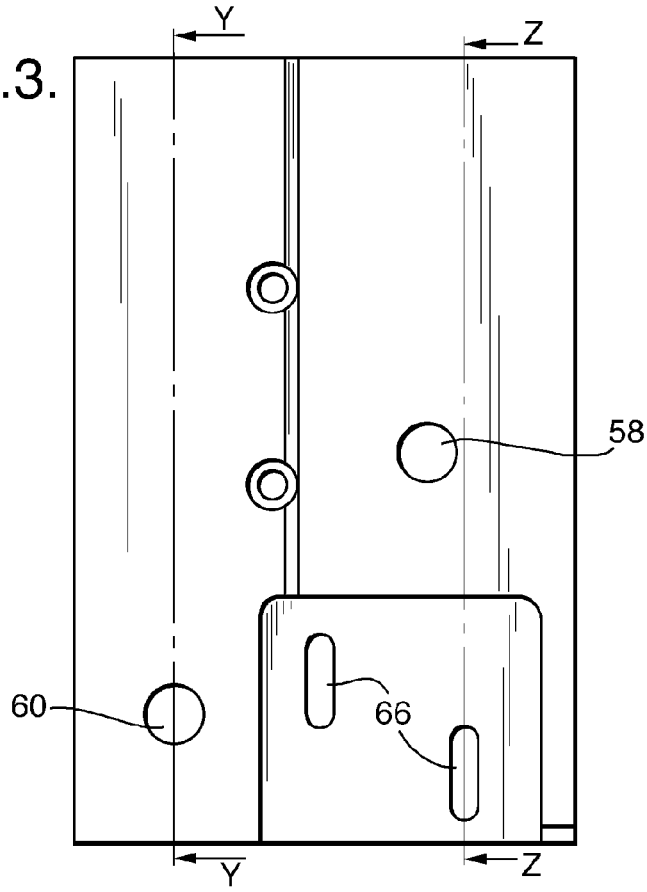
FIG. 3 is a front view of the reservoir of FIG. 2.
Figure 4:
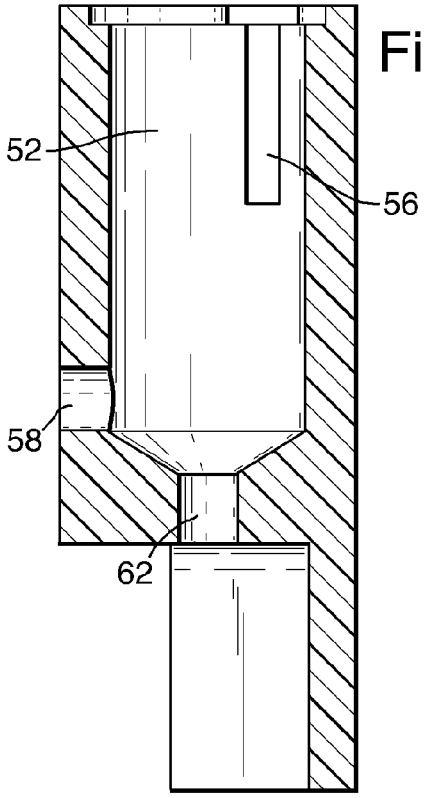
FIG. 4 is a vertical section on line Z-Z of FIG. 3.
Figure 5:
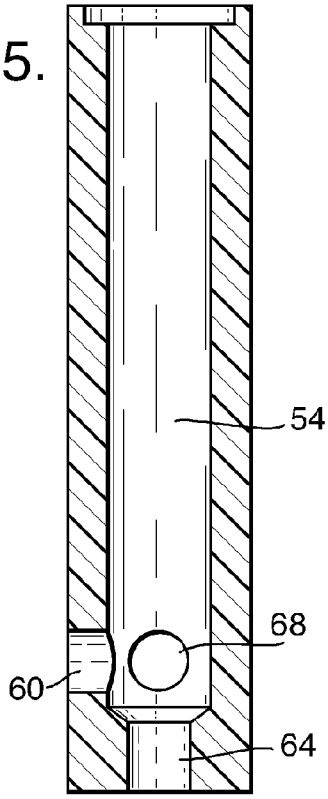
FIG. 5 is a vertical section on line Y-Y of FIG. 3.

FIG. 1 illustrates schematically an ink recirculating system in accordance with the invention, comprising a printhead reservoir shown schematically at 10, a main bulk ink supply represented schematically at 12 and a printhead represented schematically at 14.

Reservoir 10 comprises a body defining a first chamber 16 and a second chamber 18 separated by a weir 20 which functions as a transfer outlet for the first chamber and controls and maintains the level of ink 22 in the first chamber.

The base of the first chamber 16 has a printhead outlet 24 for supplying ink from the first chamber to an inlet 26 of printhead 14 via tube 28. The base of the second chamber 18 has a printhead inlet 30 for receiving ink from an outlet 32 of printhead 14 via tube 34.

An inlet 36 is provided in a side wall of the first chamber 16 for receiving ink from the main supply 12 via tube 38, and a return outlet 40 is provided in a side wall of the second chamber 18, at the same vertical level as inlet 36, for returning ink to the main supply via tube 42. A pump 44 is provided in tube 38 for circulating ink around the to system.

In use, ink is pumped by pump 44 from ink supply 12 in line 38 to inlet 36 of the first chamber 16. The ink fills the chamber 16 to the level of weir 20, at which point ink then flows over the weir into the second chamber 18. The ink fills the second chamber to a level 46 determined by outlet 40, with ink flowing from outlet 40 through tube 42 to be returned to the main supply 12, typically by the action of gravity, although a pump may optionally be supplied in tube 42 in addition to or in place of pump 44. Ink is pumped at an appropriate rate to keep the first and second chambers suitably filled, i.e. sufficiently quickly to keep the first chamber filled but not overfilled and without causing overfilling of the second chamber. A typical pump speed flow rate is about 100 ml/min.

In addition to ink circulation through the reservoir 10 and main supply 12, ink also circulates from the reservoir through the printhead 14, passing from the first chamber 16 via tube 28 to the printhead 14 with unused ink passing back through tube 34 to the second chamber 18, with the flow in this direction being produced by the pressure differential resulting from the ink in the first chamber being at a level 22 (determined by the vertical position of weir 20) that is vertically above the level 46 of ink in the second chamber (determined by the vertical position of the outlet 40), with weir 20 being vertically above outlet 40 in the position of use of the reservoir 10.

The system is sealed, and the air space above the ink in the first and second chambers is connected and controlled in known manner to provide a small constant negative pressure, typically in the range about −25 mm water to-a few hundred millimeters of water, to maintain the required constant negative pressure needed at the printhead nozzles for reliable operation. A further benefit of the presence of the air space is that it can act to damp at any pressure pulses occurring from the pumping of ink into the first chamber.

The system can be used for continuous recirculation of ink, both when the printhead is being used for printing and while the printhead is in an idle state.

The illustrated reservoir is symmetrical, with inlet 36 being at the same vertical height as outlet 40. This means the reservoir system can be readily used with ink circulation in the reverse direction by simply reversing the direction of ink flow. This can be advantageous in maintaining the printhead and clearing any blockages that may have occurred.

The arrangement of the invention thus provides a system that requires only a single printhead reservoir (containing two chambers), a single pump or equivalent means for filling the first chamber, and only two tubes (one inlet and one outlet) connected between the printhead reservoir 10 and the main bulk ink supply 12.

FIGS. 2 to 6 illustrate a prototype embodiment of a reservoir in accordance with the invention, suitable for use in an ink recirculating system as illustrated in FIG. 1.

The illustrated reservoir comprises a body 50 of machined transparent acrylic (Perspex) having a first, generally cylindrical chamber 52 having an internal diameter of 30 mm and a second, generally cylindrical chamber 54 having an internal diameter of 16 mm linked by an elongate passage or channel 56 defining a weir between the chambers.

An inlet 58 is provided through the cylindrical side wall of the first chamber, with a return outlet 60 passing through the cylindrical side wall of the second chamber.

Both chambers are of funnel-like configuration at the base, to avoid corners, sharp angles and dead spots where particles in the ink might become trapped, with a printhead outlet 62 passing through the base of the first chamber and a printhead inlet 64 passing through the base of the second chamber. The first chamber has a height (excluding the funnel-like base) of 65 mm, while the second chamber has a height (excluding the funnel-like base) of 107 mm.

The upper edge of both chambers is rebated, for receiving a generally planar mating cap (not shown) of machined transparent Perspex, removably secured thereto in sealing manner.

An ink level sensor (not shown) is provided in the first chamber, and the first chamber is of larger diameter than the second chamber to accommodate the level sensor.

The illustrated reservoir is small and light, and has a small ink capacity of about 30 ml. The reservoir can be located directly on top of a printhead, e.g. a Xaar 1001 printhead (Xaar is a Trade Mark). The total volume of ink in the ink recirculating system is about 200 ml.

The rear wall of the body 50 includes two elongate slots 66 to facilitate mounting of the reservoir.

In the illustrated embodiment, an alternative return outlet 68 is provided extending through the cylindrical side wall of the second chamber, at the same level as and at right angles to return outlet 60, permitting connection of the reservoir to a different face of the ink recirculating system. The return outlet not in use (e.g. outlet 68) is blanked off.

The invention claimed is:

1. An ink reservoir for an ink recirculating system for supplying ink to an inkjet printhead, the ink reservoir comprising a first chamber for receiving ink from a main ink supply and having a printhead outlet for supplying ink to a printhead; and a second chamber in fluid communication with the first chamber for receiving ink from the first chamber in excess of a predetermined height in the first chamber determined by the position of a transfer outlet, the second chamber having a printhead inlet for receiving ink recirculated from the printhead and having a return outlet for returning to the main ink supply ink in excess of a predetermined height in the second chamber determined by the position of the return outlet, the transfer outlet, in use, being vertically above the return outlet.

2. The reservoir according to claim 1, wherein the first and second chambers are separated by a weir.

3. The reservoir according to claim 2, wherein the first and second chambers are located side by side, linked by an opening or passage constituting the transfer outlet of the first chamber and functioning as the weir.

4. The reservoir according to claim 1, wherein the first chamber suitably includes an inlet through which ink is supplied from the main ink supply.

5. The reservoir according to claim 4, wherein the inlet is vertically below the transfer outlet.

6. The reservoir according to claim 5, wherein the inlet of the first chamber is at the same vertical height as the return outlet of the second chamber.

7. The reservoir according to claim 1, wherein the first chamber is provided with level sensor means.

8. The reservoir according to claim 1, wherein the second chamber is provided with level sensor means.

9. The reservoir according to claim 1, wherein the chambers are sealed, and means is provided for regulating the pressure in the air space in the chambers.

10. An ink recirculating system for supplying ink to an inkjet printhead, comprising an ink reservoir according to claim 1, a main ink supply, a first fluid supply line connecting the main ink supply to the first chamber of the reservoir, a second fluid supply line connecting the return outlet of the second chamber to the ink reservoir, and circulating pump means.

11. The ink recirculating system according to claim 10, including temperature regulation means for controlling the temperature of the ink.

12. An inkjet printer including an ink recirculating system in accordance with claim 10.

13. A method of providing a flow of ink from an ink reservoir to an inkjet printhead in an ink recirculating system in which ink is supplied from a main supply to a first chamber of the ink reservoir, ink from the first chamber in excess of a predetermined height in the first chamber is supplied to a second chamber of the ink reservoir, and ink from the second chamber in excess of a predetermined height in the second chamber is returned to the main ink supply for recirculation, the method comprising circulating ink from the first chamber to the second chamber through the printhead as a result of the pressure differential caused by the height of the ink in the first chamber being vertically higher than the height of the ink in the second chamber, wherein the height of the ink in the first chamber is determined by the vertical location of a transfer outlet in the first chamber for passage of ink from the first chamber to the second chamber, and the height of the ink in the second chamber is determined by the vertical location of a return outlet in the second chamber for return to the main supply.

* * * * *